United States Patent [19]

Koch

[11] Patent Number: 4,513,520

[45] Date of Patent: Apr. 30, 1985

[54] SKI BOOT WITH INNER BOOT TIGHTENING MECHANISM

[75] Inventor: Albin G. Koch, Davos-Dorf, Switzerland

[73] Assignee: Heierling of Switzerland, Ltd., Warwick, R.I.

[21] Appl. No.: 469,896

[22] Filed: Feb. 25, 1983

[51] Int. Cl.[3] ..... A43B 5/04

[52] U.S. Cl. ..... 36/119; 36/88; 36/10; 128/80 H

[58] Field of Search ..... 36/117–120, 36/10, 115, 88, 89, 93, 58.5; 128/80 H, 166

[56] References Cited

U.S. PATENT DOCUMENTS

| | | | |
|---|---|---|---|
| D. 153,731 | 5/1949 | Rominger | D2/276 |
| D. 173,971 | 2/1955 | Smith | D2/276 |
| D. 205,993 | 10/1966 | Ali | D2/276 |
| 2,660,812 | 12/1953 | Henke | 36/119 |
| 2,935,798 | 5/1960 | Piberhofer | 36/119 |
| 3,327,410 | 6/1967 | Park, Sr. et al. | 36/89 |
| 3,506,000 | 4/1970 | Baker | 128/166 |
| 3,522,668 | 8/1970 | Fesl | 36/119 |
| 3,530,594 | 9/1970 | Vogel | 36/119 |
| 4,030,215 | 6/1977 | Vogel | 36/119 |
| 4,160,332 | 7/1979 | Salomon | 36/119 |
| 4,196,530 | 8/1980 | Delery | 36/119 |
| 4,253,251 | 3/1981 | Salomon | 36/119 |
| 4,313,433 | 2/1982 | Cramer | 128/80 H |
| 4,428,130 | 1/1984 | Perotto | 36/117 |

FOREIGN PATENT DOCUMENTS

| | | | |
|---|---|---|---|
| 0057170 | 8/1982 | European Pat. Off. | 36/115 |
| 0061971 | 10/1982 | European Pat. Off. | 36/115 |
| 225507 | 3/1910 | Fed. Rep. of Germany | 36/119 |
| 241330 | 11/1911 | Fed. Rep. of Germany | 128/166 |
| 1007668 | 5/1957 | Fed. Rep. of Germany | 36/119 |
| 2450575 | 10/1980 | France | 36/119 |
| 280398 | 12/1930 | Italy | 128/80 H |

*Primary Examiner*—James Kee Chi

*Attorney, Agent, or Firm*—Roylance, Abrams, Berdo & Goodman

[57] ABSTRACT

A ski boot including a substantially rigid outer shell and a flexible inner boot, the inner boot having a tightening strap wrapped around it for tightening the inner boot's rear, arch, instep and ankle portions against the skier's foot. The inner boot has a guide loop at the rear portion and a first fastening device on the ankle portion. A secondary strap, carrying a guide ring at its end adjacent the instep portion, is connected to the tightening strap or the boot itself. The tightening strap is connected at one end to the arch portion of the boot and, after tightening, is fastened, via a second fastening device, to the first fastening device on the boot. From the connection at the arch portion, the tightening strap extends rearwardly, through the guide loop, forwardly around the ankle portion, through the guide ring and then doubles back rearwardly where the fastening devices are connected.

10 Claims, 8 Drawing Figures

SKI BOOT WITH INNER BOOT TIGHTENING MECHANISM

FIELD OF THE INVENTION

The invention generally relates to ski boots, especially those formed of a substantially rigid outer shell and a flexible inner boot. In particular the invention relates to a tightening mechanism for the inner boot, which comprises a strap wrapped around the inner boot for tightening the boot's rear portion, arch portion, instep portion and ankle portion against the skier's foot.

BACKGROUND OF THE INVENTION

In ski boot design, one of the most important requirements is to rigidly connect the skier's foot to the boot so that movements by the skier's leg are immediately translated to the ski for maximum skiing control.

Currently, most ski boots are constructed from a substantially rigid outer shell formed of plastic and a substantially flexible inner boot received in the outer shell, this inner boot being formed of foamed plastic covered with leather or rubber. This construction, due to the rigidity of the outer shell, has been a vast improvement over the prior all-leather ski boots, which allowed large amounts of relative movement between the foot and the boot. However, a relatively loose fit is still present due to possible movement of the skier's foot relative to the inner boot. This especially occurs in well used boots where the resilience of the foam decreases.

While numerous prior art devices have attempted to rigidly support a skier's foot in a boot, these devices have not been entirely satisfactory and there is a need for improvement. Examples of these prior art devices are disclosed in U.S. Pat. Nos. Des. 153,731 to Rominger; 173,971 to Smith III; and 205,993 to Ali; and U.S. Pat. Nos. 2,660,812 to Henke; 2,935,798 to Piberhofer; 3,327,410 to Park, Sr. et al; 3,522,668 to Fesl; 3,530,594 and 4,030,215 to Vogel; and 4,160,332 to Salomon. In addition, such prior art devices are disclosed in German Pat. Nos. 225,507 and 1,007,668.

SUMMARY OF THE INVENTION

Accordingly, a primary object of the invention is to provide a ski boot with an inner boot tightening mechanism to rigidly connect the skier's foot to the inner boot.

Another object of the invention is to provide such a tightening mechanism that is simply constructed, relatively inexpensive to make and relatively simple to use.

Another object of the invention is to provide a ski boot having a substantially rigid outer shell and a substantially flexible inner boot with a tightening mechanism that comprises a strap wrapped around the inner boot.

The foregoing objects are basically attained by providing in a ski boot having a substantially rigid outer shell, a flexible inner boot including an arch portion, a rear portion and an instep portion and received in the outer shell, and closure means for closing the outer shell, the improvement comprising a mechanism, coupled to the inner boot, for tightening the inner boot relative to the foot of the skier, this mechanism including a means for forcing the arch portion of the inner boot generally upwardly towards the arch of the skier's foot, a means for forcing the rear portion of the inner boot generally forwardly towards the Achilles tendon of the skier's foot, and a means for forcing the instep portion of the inner boot generally downwardly towards the instep of the skier's foot. In addition, the tightening mechanism also includes a means for forcing the outer side of the ankle portion of the inner boot generally inwardly towards the outer side of the skier's ankle.

Advantageously, the tightening mechanism comprises a main tightening strap and a secondary strap, the secondary strap having a guide ring at an end for receiving the tightening strap therein.

In the embodiments of FIGS. 1–6, the secondary strap is directly fastened to the main tightening strap. In the embodiment of FIG. 7, the secondary strap is directly connected to the inner boot above the main tightening strap, while in the embodiment of FIG. 8 the secondary strap is directly connected to the inner boot below the main tightening strap.

Other objects, advantages and salient features of the invention will become apparent from the following detailed description, which, taken in conjunction with the annexed drawings, discloses preferred embodiments of the invention.

DRAWINGS

Referring now to the drawings which form a part of this original disclosure:

Figure 7:
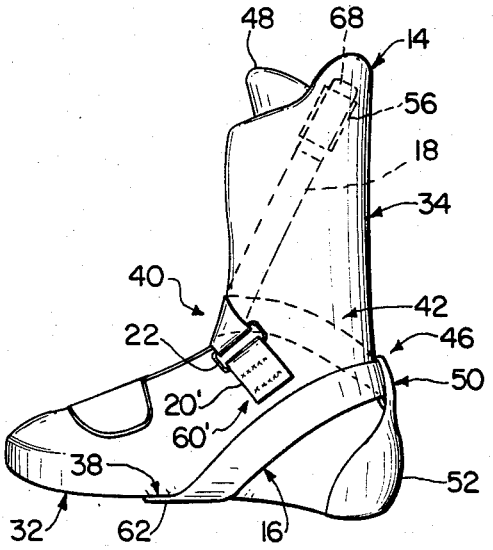
Figure 8:
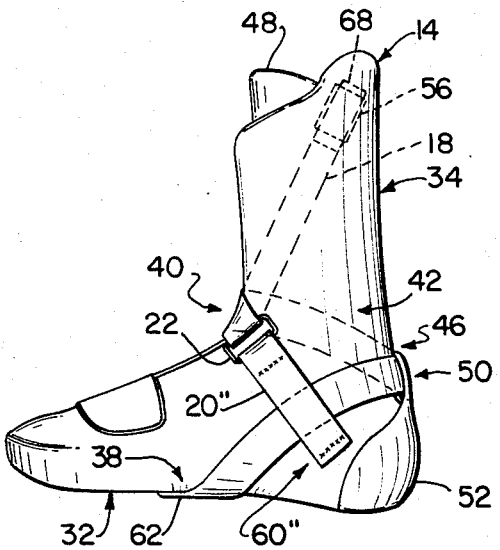

FIG. 7 is a right side elevational view of a second embodiment of the invention in which the secondary strap carrying the guide ring is directly connected to the inner boot above the main tightening strap; and FIG. 8 is a right side elevational view of a third embodiment of the invention in which the secondary strap carrying the guide ring is directly connected to the inner boot below the main tightening strap.

DETAILED DESCRIPTION OF THE INVENTION

As seen in FIGS. 1–6, the invention comprises a ski boot 10 including a substantially rigid outer shell 12 formed of plastic and a substantially flexible inner boot 14 formed from foamed plastic with a rubber or leather outer covering, the inner boot having a tightening mechanism 16 wrapped around it for tightening the inner boot to the skier's foot. The tightening mechanism 16 comprises a main tightening strap 18, a secondary strap 20 and a ring 22 coupled to an end of the secondary strap for receiving the main tightening strap 18 therein. As will be described in more detail hereinafter, advantageously the tightening mechanism tightens the boot's rear portion, arch portion, instep portion and ankle portion against the skier's foot.

Figure 1:
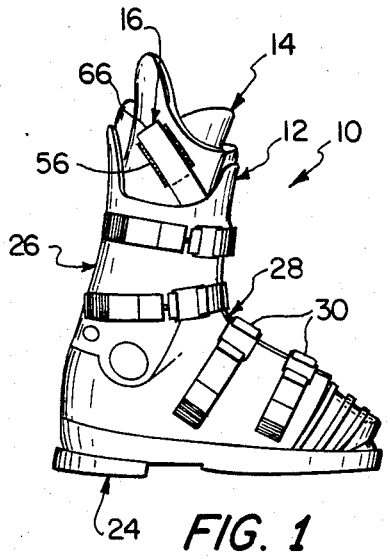
FIG. 1 is a left side elevational view of a ski boot in accordance with the invention, this view illustrating the outer side of a right boot.
Figure 2:
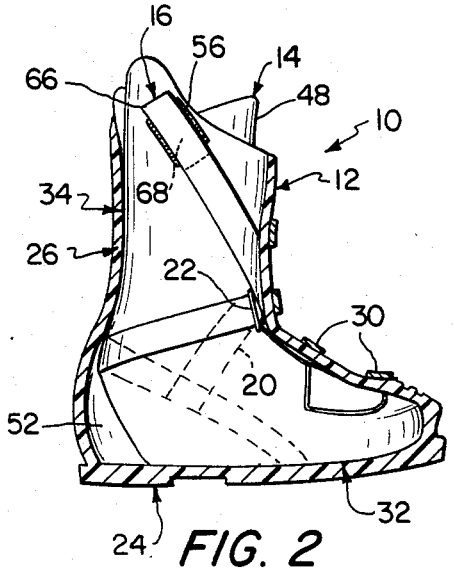
FIG. 2 is a left side elevational view in longitudinal section of the boot shown in FIG. 1 illustrating how the inner boot carrying the tightening mechanism is received inside the outer shell.

As seen in FIGS. 1 and 2, the outer shell 12 comprises a sole 24, an integral upper 26 having a central seam 28 therein to allow the outer shell to be opened, and a set of buckle closures 30 for releasably closing the outer shell.

For ease of understanding, throughout this specification, a right boot will be illustrated, it being understood that the left boot would have a mirror image construction.

Figure 3:
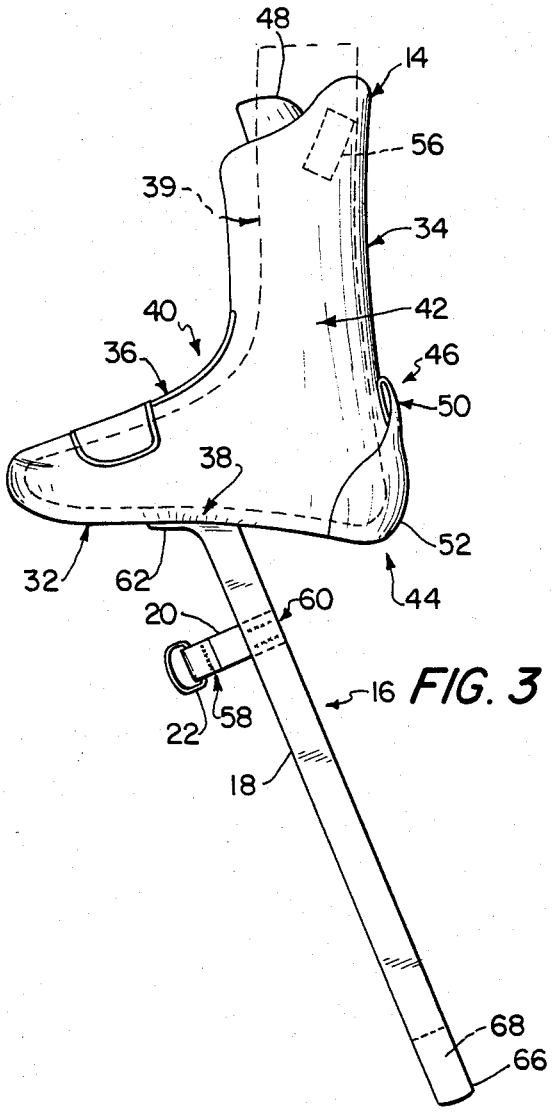
FIG. 3 is a right side elevational view of the inner boot showing the inner side of the boot with the tightening strap being removed from its connection with a guide loop at the rear of the inner boot.

As seen in FIG. 3, the inner boot 14 comprises a sole 32 and an upper 34 having a seam 36 therein. As with any conventional boot the inner boot 14 has an arch portion 38 on the sole 32 and an instep portion 40, an ankle portion 42, a heel portion 44, a rear portion 46 located above the heel portion, and a tongue 48. As is evident, the arch portion 38 of the boot is below the arch portion of the skier's foot 39, the instep portion 40 of the boot overlies the instep of the skier's foot, the ankle portion 42 of the boot surrounds the skier's ankle, the heel portion 44 of the boot surrounds the skier's heel, and the rear portion 46 of the boot is adjacent the Achilles tendon area of the skier's foot above the heel.

Figure 4:
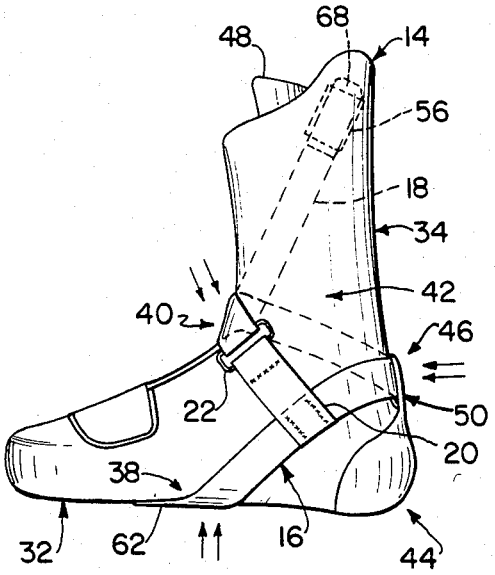
FIG. 4 is a right side elevational view similar to that shown in FIG. 3 except that the tightening strap has been wrapped around the inner boot into its tightening position.
Figure 5:
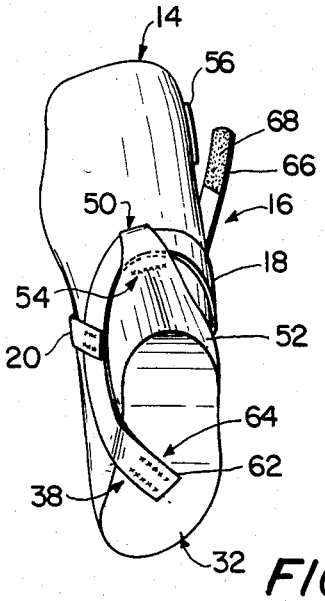
FIG. 5 is a rear perspective view of the inner boot shown in FIG. 4 specifically showing the connection of the tightening strap to the arch portion of the inner boot.

As seen best in FIGS. 2–4, a guiding member in the form of a loop 50 is connected to the inner boot 14 by a heel piece 52 conformed with and located at the heel portion 44 of the boot, with the loop 50 being located at the rear portion 46 adjacent the skier's Achilles tendon. As seen in FIGS. 3 and 5, advatnageously loop 50 is formed by overlapping the end of the heel piece 52 and securing the end by stitching 54. As seen in FIGS. 4 and 5, the main strap 18 is received in loop 50.

As indicated in FIGS. 1–6, on the outer side of the inner boot, which is the right hand side of the boot as viewed by the wearer, a releasable first fastening device 56 is coupled to the outer surface. Advantageously, this fastening device 56 can be the hook or eye portion of a Velcro fastener, although other suitable fasteners can be used.

As best seen in FIG. 3, the tightening mechanism comprises the elongated main tightening strap 18, the secondary strap 20 which extends substantially perpendicularly from the main strap, and the guide ring 22. Ring 22 is advantageously connected to the secondary strap 20 by passing an end of the strap through the ring and folding it back over itself and fastening this end by stitching or rivets 58. Similarly, the secondary strap 20 is connected to the main strap at its other end by stitching or rivets 60.

The main strap 18 has a first end 62 coupled, such as by stitching or rivets 64, to the outer surface of the bottom of the inner boot sole 32 at the arch portion 38, as best seen in FIGS. 3–5.

The second end 66 on the main strap has a second fastening device 68 coupled thereto, this device being a hook or eye portion of a Velcro fastener or other equivalent fasteners. This second fastening device 68 is releasably connected to the first fastening device 56 which is coupled to the inner boot 14 itself.

As seen by comparing FIGS. 3 and 4, the tightening mechanism 16 is coupled to the outer surface of the bottom of the inner boot at the arch portion 38 via the connection of the first end 62 of the main strap 18 to the boot. From that connection, the main strap 18 extends rearwardly through loop 50, around the ankle portion 42 as seen in FIGS. 2 and 6, through ring 22 on the secondary strap 20 and then doubles back over itself and extends rearwardly and upwardly for interconnection of the first fastening device 56 on the boot and the second fastening device on strap 18.

Figure 6:
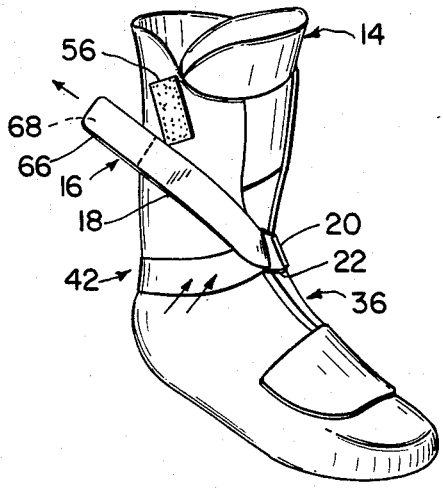
FIG. 6 is a front perspective view of the inner boot with the tightening strap being pulled rearwardly to tighten the inner boot relative to the skier's foot.

The tightening action, created by pulling rearwardly on strap 18, is illustrated in FIGS. 4 and 6 wherein the main strap forces the arch portion 38 of the inner boot generally upwardly towards the arch of the skier's foot, forces the rear portion 46 of the inner boot generally forwardly towards the Achilles tendon of the skier's foot, forces the instep portion 40 of the inner boot generally downwardly towards the instep of the skier's foot, and forces the outer side of the ankle portion 42 of the inner boot generally inwardly towards the outer side of the skier's ankle, as indicated by the four sets of double arrows shown in FIGS. 4 and 6.

As seen in FIGS. 2, 4 and 6, the ring 22 is generally located adjacent the instep portion 40 of the inner boot approximately over the seam 36. The precise location of the ring 22 relative to the seam is not absolutely critical and thus the ring can be on either side or directly over the seam, this varying depending upon how tightly the strap 18 is pulled and the length of the secondary strap 20. In all events, it is advantageous for the ring 22 to be adjacent the instep portion 40 so that the strap 18 in combination with secondary strap 20 can exert a force downwardly on the instep portion and inwardly on the ankle portion.

The fully tightened tightening mechanism 16 is illustrated in FIGS. 1 and 2 with the tightening mechanism being located between the outer surface of the inner boot and the inner surface of the outer shell. Advantageously, the tightening mechanism can be utilized while the inner boot is located inside the outer shell. A cut out in the outer shell for easy access to the second end of strap 18 is not absolutely necessary as long as access to the strap is obtainable while the skier is wearing the boot, such as when the top buckles are open. In addition, it is possible to place the inner boot on the skier's foot and tighten it before the inner boot is placed in the outer shell, although this is not preferred.

Embodiment Of FIG. 7

The embodiment seen in FIG. 7 is substantially the same as the structure described above and shown in FIGS. 1–6 except that the secondary strap 20' is modified so that it is fastened via stitching or rivets 60' directly to the inner boot above the main strap, as that strap extends from the arch portion to the loop. Since the remaining parts are the same, they are given like reference numerals.

Embodiment Of FIG. 8

The embodiment of FIG. 8 is similar to that shown in FIG. 7 except that the further modified secondary strap 20'' is elongated and is directly connected via stitching 60'' to the outer surface of the inner boot below the main strap, between that strap and the leather heel piece 52. As seen in FIG. 8, the secondary strap 20'' overlaps the main strap, although this can be reversed if desired. Since the remaining parts are the same as those discussed above regarding FIGS. 1–6, like elements are given the same reference numerals.

While various advantageous embodiments have been chosen to illustrate the invention, it will be understood by those skilled in the art that various changes and modifications can be made therein without departing from the scope of the invention as defined in the appended claims.

What is claimed is:

1. In a ski boot having a substantially rigid outer shell, a flexible inner boot including an outer surface, an arch portion, a rear portion, an ankle portion and an instep portion and received in the outer shell, and closure means for closing the outer shell, the improvement comprising:

means, coupled to the inner boot and engaging the outer surface thereof, for tightening the inner boot relative to the foot of the skier, said means including means for forcing the arch portion of the inner boot generally upwardly towards the arch of the skier's foot, means for forcing the outer side of the ankle portion of the inner boot generally inwardly towards the outer side of the skier's ankle, means for forcing the rear portion of the inner boot generally forwardly towards the Achilles tendon of the skier's foot, and means for forcing the instep portion of the inner boot generally downwardly towards the instep of the skier's foot, said means further including a single tightening strap, said tightening strap having a first end rigidly coupled to the outer surface of the bottom of the inner boot at the arch portion and a free second end located rearward of the instep portion and above the ankle portion of the inner boot, said tightening strap engaging the outer surface of the inner boot between said first and second ends;

means for releasably fastening said free second end to the inner boot rearward of the instep portion and above the ankle portion of the inner boot; and a ring coupled to one of the inner boot outer surface and said tightening strap, and located adjacent the instep portion and on the outer surface of the inner boot, said tightening strap extending rearwardly from its coupling at the arch portion, around the rear portion, around the ankle portion, through said ring, and then rearwardly for the releasably fastening of said second end.

2. The improvement according to claim 1, wherein said ring is coupled to said tightening strap.

3. The improvement according to claim 1, wherein said ring is coupled to the inner boot outer surface.

4. The improvement according to claim 1, wherein said means for tightening further comprises a loop coupled to the rear portion of the inner boot and on the outer surface for receiving said tightening strap therein.

5. The improvement according to claim 1, wherein said means for releasably fastening comprises a first fastening device coupled to the inner boot above the ankle portion and on the outer surface, and a second fastening device releasably connectable with said first fastening device and located on said tightening strap second end.

6. In a ski boot having a substantially rigid outer shell, a flexible inner boot including an outer surface, an arch portion, a rear portion, an instep portion and an ankle portion and received in the outer shell, and closure means for closing the outer shell, the improvement comprising:

a loop coupled to the rear portion of the inner boot and on the outer surface;

a first fastening device coupled to the inner boot above the ankle portion and on the outer surface;

a single tightening strap having first and second ends, said first end being rigidly coupled to the outer surface of the bottom of the inner boot at the arch portion thereof and said second end having a second fastening device releasably connectable with said first fastening device; and a ring coupled to said tightening strap, and located adjacent the instep portion and on the outer surface, said tightening strap extending rearwardly from its coupling at the arch portion, through said loop, around the ankle portion of the inner boot, through said ring, and then rearwardly for interconnection of said first and second fastening devices, said tightening strap engaging the outer surface of the inner boot between said first and second ends.

7. In a ski boot having a substantially rigid outer shell, a flexible inner boot including an outer surface, an arch portion, a rear portion, an instep portion and an ankle portion and received in the outer shell, and closure means for closing the outer shell, the improvement comprising:

a loop coupled to the rear portion of the inner boot and on the outer surface;

a ring coupled to the inner boot, and located adjacent the instep portion and on the outer surface;

a first fastening device coupled to the inner boot above the ankle portion and on the outer surface; and a single tightening strap having a first and second ends, said first end being rigidly coupled to the outer surface of the bottom of the inner boot at the arch portion thereof and said second end having a second fastening device releasably connectable with said first fastening device, said tightening strap extending rearwardly from its coupling at the arch portion, through said loop, around the ankle portion of the inner boot, through said ring, and then rearwardly for interconnection of said first and second fastening devices, said tightening strap engaging the outer surface of the inner boot between said first and second ends.

8. The improvement according to claim 7, wherein said ring is coupled to the inner boot above said tightening strap.

9. The improvement according to claim 7, wherein said ring is coupled to the inner boot below said tightening strap.

10. In a flexible boot including an outer surface, an arch portion, a rear portion, an ankle portion, and an instep portion, the improvement comprising:

means, coupled to the boot and engaging the outer surface thereof, for tightening the boot relative to the foot of the wearer, said means including means for forcing the arch portion of the boot generally upwardly towards the arch of the wearer's foot, means for forcing the outer side of the ankle portion of the boot generally inwardly towards the outer side of the wearer's ankle, means for forcing the rear portion of the boot generally forwardly towards the Achilles tendon of the wearer's foot, and means for forcing the instep portion of the boot generally downwardly towards the instep of the wearer's foot, said means further including a single tightening strap, said tightening strap having a first end rigidly coupled to the outer surface of the bottom of the boot at the arch portion and a free second end located rearward of the instep portion and above the ankle portion of the boot, said tightening strap engaging the outer surface of the boot between said first and second ends;

means for releasably fastening said free second end to the boot rearward of the instep portion and above the ankle portion of the boot; and a ring coupled to one of the boot outer surface and said tightening strap, and located adjacent the instep portion and on the outer surface of the boot, said tightening strap extending rearwardly from its coupling at the arch portion, around the rear portion, around the ankle portion, through said ring and then rearwardly for the releasable fastening of said second end.

* * * * *